US006270316B1

(12) United States Patent
Precetti

(10) Patent No.: US 6,270,316 B1
(45) Date of Patent: Aug. 7, 2001

(54) PUMP WITH SUCTION AND DELIVERY OPENING ALONG THE SAME AXIS EASY TO DISMANTLE

(75) Inventor: Massimo Precetti, Fosdinovo (IT)

(73) Assignee: Termomeccanica S.p.A.

( * ) Notice: Subject to any disclaimer, the term of this patent is extended or adjusted under 35 U.S.C. 154(b) by 0 days.

(21) Appl. No.: 09/348,448

(22) Filed: Jul. 7, 1999

(30) Foreign Application Priority Data

Jul. 9, 1998 (IT) ..... MI98A1570

(51) Int. Cl.[7] ..... F01D 1/02
(52) U.S. Cl. ..... 415/201
(58) Field of Search ..... 415/201

(56) References Cited

U.S. PATENT DOCUMENTS 1,700,678 1/1929 Jennings .
2,250,306 4/1941 La Bour .
2,868,134 1/1959 Nagle .
3,079,865 3/1963 Lipe ..... 415/201
3,601,498 * 8/1971 Schroeder ..... 415/201
3,847,504 11/1974 Martin .

FOREIGN PATENT DOCUMENTS 785740 8/1935 (FR) .

* cited by examiner

*Primary Examiner*—John E. Ryznic
(74) *Attorney, Agent, or Firm*—Hedman & Costigan, P.C.

(57) ABSTRACT

A pump with suction and delivery openings along the same axis, easy to dismantle, and consisting of a body (12), with an impeller (24) to which an actuator means (16) is connected, the body being provided on one side with a suction opening (19) and on the other with a delivery opening (20) positioned along the same axis, the body of the pump (12) having a cover (18) easily removable from below, since the body is placed on a raised base (13) open on one side.

16 Claims, 2 Drawing Sheets

PUMP WITH SUCTION AND DELIVERY OPENING ALONG THE SAME AXIS EASY TO DISMANTLE

The present invention refers to a pump with suction and delivery openings along the same axis, easy to dismantle, with minimum removal of the fixed parts, in particular of the actuator and of the suction and delivery hoses.

In pumps with suction and delivery openings along the same axis, usually known as "in line pumps", ordinary maintenance and replacement of the impeller, seals and any wear rings or internal parts in general, usually require fairly complex operations.

It is, in fact, necessary to remove the motor, then open the body and remove the internal parts in question.

This operation must be repeated each time such repairs are necessary, causing long periods of dead times and requiring complex dismantling and reassembly procedures.

Moreover, this operational procedure has many drawbacks in particular in naval systems where pumps are installed in extremely limited areas making maintenance procedures even more difficult.

It is an object of the present invention to provide a pump of said type, wherein internal repairs can be carried out, without having to remove the motor and other parts connected thereto.

It is a further object of the present invention to provide a pump which does not present the previous construction drawbacks of known models, while at the same time offering excellent seals and efficient performance.

The above objects, in accordance with the present invention, can be attained by providing an easy to dismantle pump with suction and delivery openings along the same axis, as described above. Further characteristics are described in the appended claims.

Figure 1:
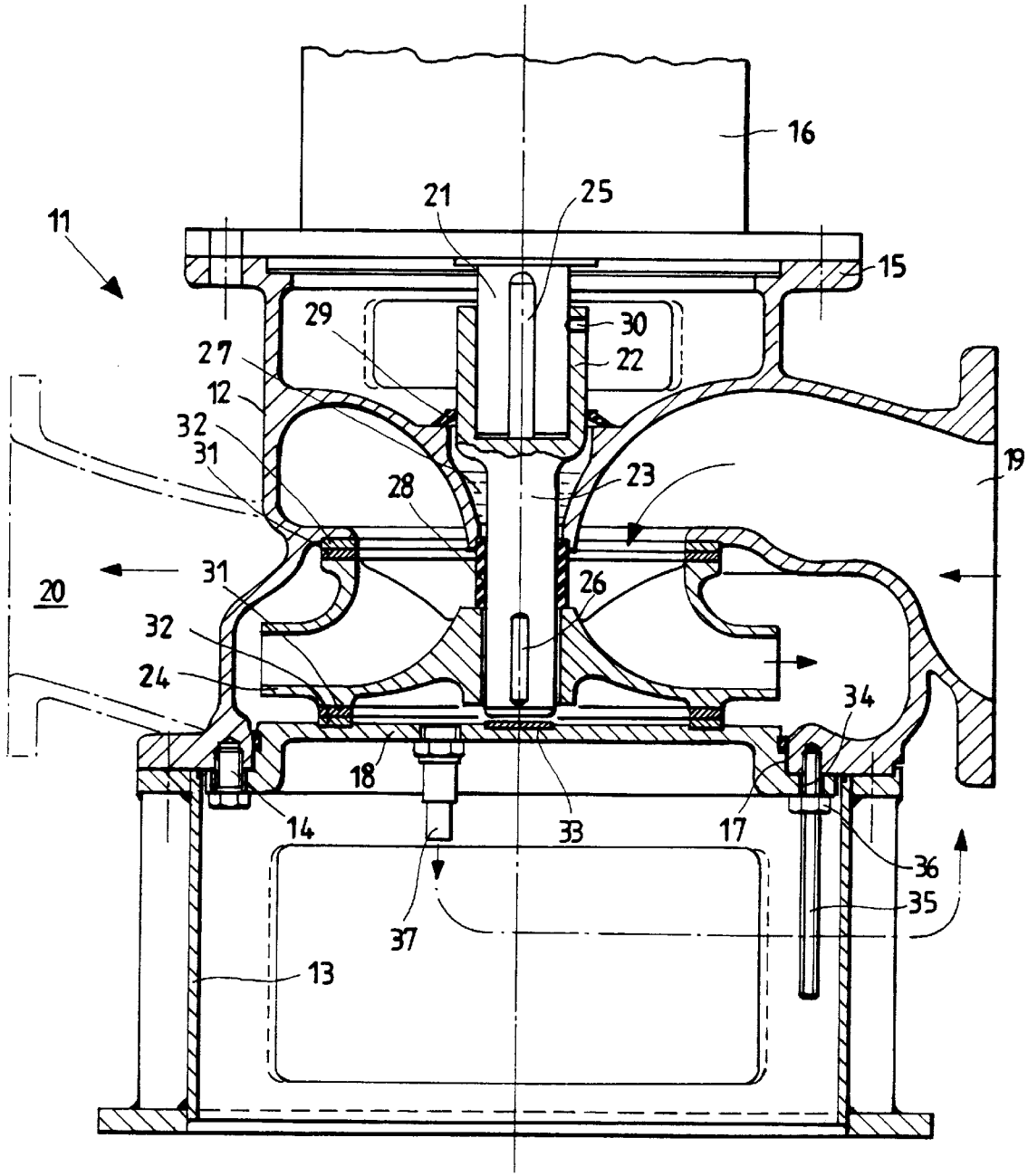
Figure 2:
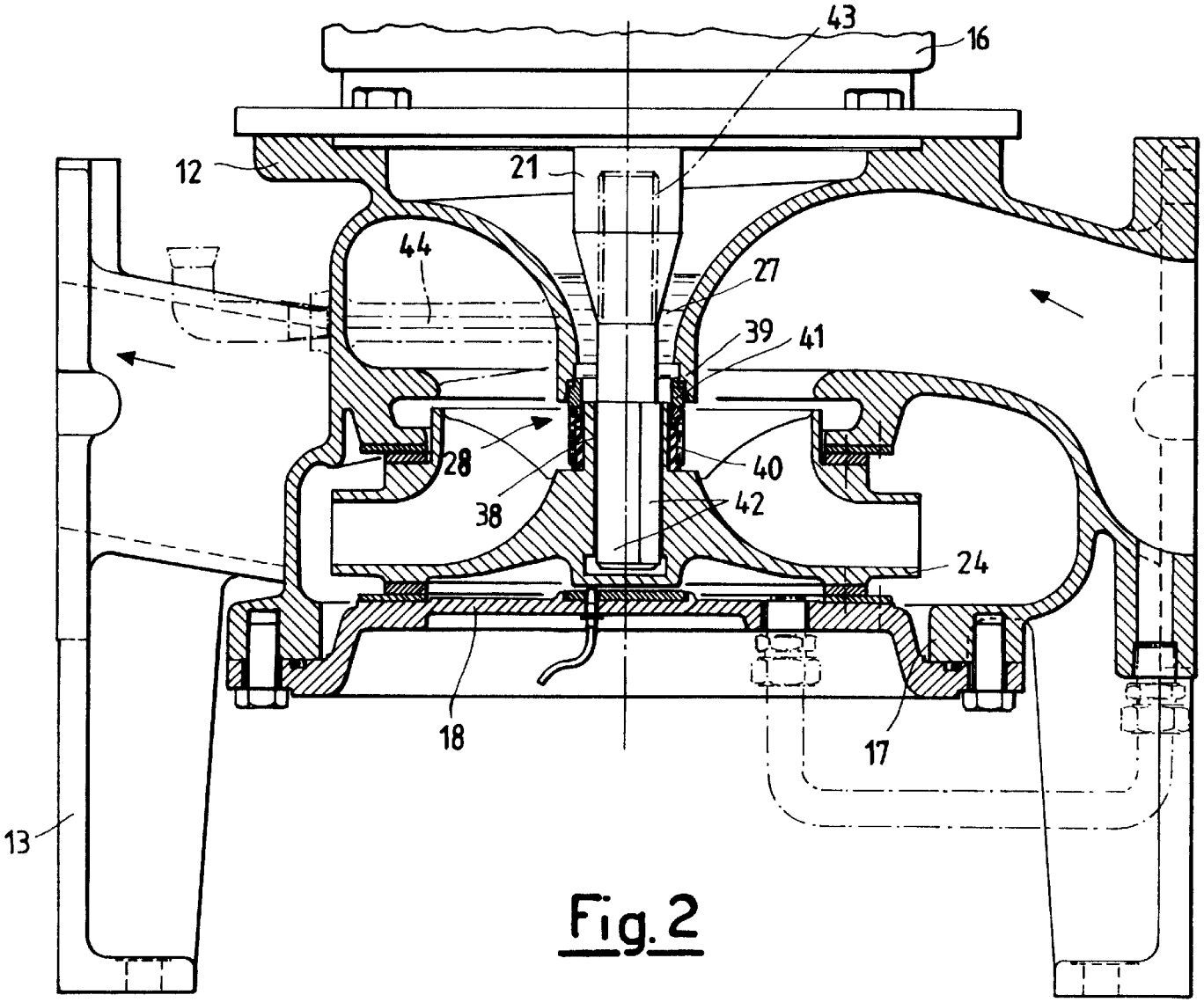

The characteristics and the advantages of a pump, with suction and delivery openings along the same axis, easy to dismantle, will become apparent from the following description, given herein solely by way of example and not binding, with reference to the drawings wherein:

FIG. 1 is a sectional view of the pump with the features described in the present invention; and FIG. 2 is a sectional view of a second embodiment of the pump according to the present invention.

In FIG. 1, there is shown a cross-sectional view of a pump with suction and delivery openings along the same axis, which can be easily dismantled, which is diagrammatically illustrated and indicated as a whole by number 11.

The pump 11 consisting of a body 12 is placed on a base 13 by means of bolts (not shown) and an actuator means 16, consisting of an electric or diesel motor, or a turbine etc., fixed at the top in correspondence with flanged portions 15. The body 12 is open at the bottom in 17 to receive the lower cover 18 which is fixed to the body itself by bolts 14, for example, three in number.

The body 12 is also provided with a suction opening 19 on one side and a delivery opening 20 on the other side. From the top actuator 16 an output shaft 21 extends inside the body 12 and enters the bell end portion 22 of the driving shaft 23 of the impeller 24. The output shaft 21 is axially constrained by a spline 25 to the driving shaft 23 and locked by a security pin 30, preventing a downwards sliding movement. The driving shaft 23 drives, integral with the rotation, the impeller by means of a second spline 26; the impeller 24 is free to axially slide when the lower cover 18 is removed.

The driving shaft 23 is made of appropriate material resistant to liquids to be pumped (for example stainless steel for sea water).

The driving shaft 23 can however be replaced by an extension of the output shaft 21 of the actuator device 16 where the use of special materials for the driving shaft 23 is not necessary.

There is a narrow channel 27 of dimensions only slightly larger than the driving shaft 23, in the upper part of the body 12, containing the oil or lubricant necessary for a good operation of the mechanical seal 28 positioned on the driving shaft 23 above the impeller 24. A V shaped seal ring 29 is positioned in correspondence with the upper edge of the narrow channel 27 to prevent dust or impurities from building up in the channel itself, thus preventing pollution of the lubricant.

The impeller 24 is fitted with wear rings 31 facing outwards, onto radial surfaces co-operating with further wear rings 32 integral with the body 12, on one side and with the lower cover 18 on the other side. Wear rings 31 and 32 can be built as applied or enbloc rings in wear-resistant material, facing each other. The presence of radial rings avoids damage to pump components.

The lower cover 18 moreover provides centrally a disc 33, facing the lower end of the driving shaft 23, which is used in the case of accidental failure of the shaft itself to avoid direct contact with the lower cover 18, preventing further damage to the entire pump.

It must also be understood that in accordance with the present invention the lower cover 18 provides other through holes 34 wherein threaded pins 35 can slide, being constrained at one end of the same in the lower part of the body 12 and fading downwards. Nuts 36 are placed onto the said threaded pins 35 contrasting the external surface of the lower cover 18 itself. A pipe 37 is fixed onto one part of the cover to remove any leaked liquids from the lower delivery chamber, sending them back to the suction opening 19.

In a preferred embodiment, the base 13 consists of a upside-down U section, open towards opposite sides, to allow for an easier dismantling, without inconveniences, of the internal pump components from the bottom. As is evident from the drawing and from the previous description, when it is necessary to dismantle the pump, the procedure is as follows, and no removal of the actuator, hoses and base is required.

After unscrewing the bolts 14, it is possible to lower the cover 18 guided by the threaded pins 35. For this purpose, unscrewing the bolts 36, the cover 18 is then free to descend along the same.

The impeller 24 will also descent together with cover 18 since it rests on the cover 18, being positioned axially sliding on the driving shaft 23.

A complete removal of the nuts 36 makes it possible to remove the cover and the impeller from the bottom of the base 13 which is open at the sides.

It is then possible to remove the mechanical seal 28 from the driving shaft 23, which was previously above the impeller 24.

The positioning in such a way of the mechanical seal on the shaft does not require, as in normal applications, the fluxing of the fixed and mobile parts, since the same are immersed in the liquid and cooled by the suction flow.

It is possible to provide for a seal directly fitted onto the shaft with a protective liner according to the service required.

The impeller 24 can thus be overhauled or replaced, as can the mechanical seal 28, before returning to operational conditions extremely rapidly and in precise alignment. In fact, since the actuator 16 has not been removed the precise axial alignment and the alignment of the moving parts inside the body 12 remains unaltered.

It is possible, for example, to replace the wear rings 31 on the impeller 24, while the wear rings 32 of the body 12 are in particularly resistant material and do not need replacing.

Once the required operation has been completed, it is possible to reassemble the impeller by simply raising the cover 18 on the threaded pins 35. The nuts 36 hold the cover in the raised position and then in the closed position. Once the final position is reached, the cover 18 is locked by fastening the bolts 14.

It must be noted that the pump with suction and delivery openings along the same axis according to the present invention is assembled inverted with respect to normal applications. In this way it is possible to obtain the narrow channel 27 that serves as a lubricant reservoir.

Thanks to the short length of the driving shaft 23, there is no need, in the pump according to the present invention, for guide bearings. Therefore, elements subject to wear and requiring maintenance are eliminated.

A further advantage to be noted is that the impeller and other associated parts do not require fixing means with respect to the axis. Thus no thrust is transmitted to the actuator located above.

Thrust of the impeller is absorbed by the radial wear rings which centre it in the volute of the body for improved performance.

Performance is also optimised thanks to the recovery of the pumped liquid, as described above, without balancing bores on the impeller, which cause a considerable efficiency loss in known pumps.

As already mentioned, in the event of a breakdown, the pump has no metallic parts in contact, thanks to the simultaneous presence of the wear rings 31 and 32 and of the lower disc 33 on the cover. The pump is therefore extremely safe and reliable.

FIG. 2 shows a cross-section of a second embodiment of the pump in accordance with the present invention, in which equivalent elements are indicated with the same reference numbers.

The base 13 is simply an extension towards the bottom of body 12, formed of lateral feet moulded enbloc with the pump body. The lower cover 18 is positioned in correspondence with the opening 17, in the body 12 which is made in one single element.

The motor 16 supports shaft 21 which is directly connected to the impeller 24 in engagement with the rotation by a three-lobed end 42.

Actually, between the shaft 21 and the impeller 24 a coupling, such as a three-lobed joint, or a threaded screw, shown by a dash-and-dot line in 43, designed to prevent slipping of the parts during rotation of the impeller, can be provided.

FIG. 2 shows that a rotating mechanical seal 28 is provided between a tubular extension 38 on the top of the impeller 24 and a convergent part 39 towards the bottom of the body 12, where the narrow channel 27 for oil or other lubricant is provided. A hose 44 shown by a dash-and-dot line connecting the oil and the reservoir may also be included. In this case the seal 28 comprises a packed rotating lower part 40 and a fixed upper part 41, fitted with a seal ring. This type of seal arrangement makes it possible to dismantle the motor 16 without emptying the pumping circuit and also said seals 28, 40 and 41 are dismantled and moved downwards together with the impeller when it is dismantled.

This embodiment resolves the same drawbacks as the first embodiment and offers the same advantages of the present invention.

What is claimed is:

1. A method of removing an impeller (24) from a pump with a suction opening (19) and a delivery opening (20) along the same axis, comprising the steps of:

supporting said pump at a height that will allow removal of an impeller (24) from a base (13);

unscrewing bolts (14);

lowering a cover (18) and said impeller which rests on said cover;

descending said impeller to the point where said impeller is free of shaft (21); and removing the cover and the impeller from the base (13).

2. A pump with suction and delivery openings along the same axis, with a means for dismantling comprising:

a body (12) housing an impeller (24) to which an actuator means (16) is connected, said body being provided on one side with a suction opening (19) and on the other side with a delivery opening (20) positioned on the same axis, characterized in that the lower part of said body (12) has a cover (18) freely movable from below with through holes (34) wherein threaded pins (35) can slide, said body being supported on a base plate (13) which is laterally open.

3. A pump, according to claim 1, wherein said impeller (24) is positioned axially sliding on a shaft (21,23) connected to said actuator means (16).

4. A pump, according to claim 1, wherein said impeller (24) is fitted with wear rings (31) facing outwardly on radial surfaces which cooperate with other wear rings (32) integrally placed on said body (12), on one side and on side lower cover (18), on the other side.

5. A pump, according to claim 1, wherein said cover (18) has through holes (34) wherein threaded pins (35) are fitted constrained to a lower part of said body and facing downwards, wherein nuts (36) movable along these threaded pins and acting on the external surface of said cover are provided.

6. A pump, according to claim 1, wherein said actuator (16) extends into an output shaft (21) in turn linked to a driving shaft (23) which rotates said impeller (24).

7. A pump, according to claim 5, wherein said output shaft (21) engages upon rotation with a bell end portion (22) of said driving shaft (23).

8. A pump, according to claim 1, wherein said actuator means (16) extends in an output shaft (21) linked by a coupling to said impeller (24).

9. A pump, according to claim 8, wherein said coupling has a lobe shaped end (42) on said shaft (21) which engages in rotation with said impeller (24).

10. A pump, according to claim 3, wherein an axially sliding mechanical seal (28) is positioned above said impeller (24) on said shaft (21,23).

11. A pump, according to claim 10, wherein above said mechanical seal (28) there is a narrow channel (27) containing lubricant.

12. A pump, according to claim 11, wherein above said narrow channel (27) there is a seal ring (29) engaging with said shaft (21,23).

13. A pump, according to claim 3, wherein above said impeller (24) on said shaft (21,23) there is a mechanical seal (28) comprising a fixed part (41) with respect to said body (12) and a rotating part (40) which is positioned on a tubular extension (38) facing the top part of said impeller (24), removable with said impeller.

14. A pump, according to claim 1, wherein from said cover (18) extends a hose (37) which recovers from a lower part of the delivery chamber of said pump leaks of liquid, and then sends them back to said suction opening.

15. A pump, according to claim 1, wherein said base (13) is formed as an overturned "U" section.

16. A pump, according to claim 2, wherein said wear rings (31) are removable.

* * * * *